US005421408A

United States Patent [19]

Stoisits et al.

[11] Patent Number: 5,421,408

[45] Date of Patent: Jun. 6, 1995

[54] SIMULTANEOUS WATER AND GAS INJECTION INTO EARTH FORMATIONS

[75] Inventors: Richard F. Stoisits, Anchorage, Ak.; Miroslav M. Kolpak, Arlington, Tex.; Gordon J. Krist; Tuan D. Ma, both of Anchorage, Ak.; Richard L. Payne, Mckinney, Tex.; Jeffry A. Rugen, Eagle River, Ak.; Anthony C. Schwarz; Michael C. Vincent, both of Anchorage, Ak.; Gary K. Youngren, Plano, Tex.

[73] Assignee: Atlantic Richfield Company, Los Angeles, Calif.

[21] Appl. No.: 227,837

[22] Filed: Apr. 14, 1994

[51] Int. Cl.[6] ..... E21B 43/16

[52] U.S. Cl. ..... 166/274; 166/275; 166/67

[58] Field of Search ..... 166/268, 274, 275, 303, 166/273, 309, 305.1

[56] References Cited

U.S. PATENT DOCUMENTS

| | | | |
|---|---|---|---|
| 2,240,550 | 5/1941 | Conlon, Jr. | 166/268 X |
| 3,084,743 | 4/1963 | West et al. | 166/273 |
| 3,472,320 | 10/1969 | Dyes | 166/273 |
| 3,525,395 | 8/1970 | Chew | 166/274 |
| 3,599,716 | 8/1971 | Thompson | 166/274 X |
| 3,599,717 | 8/1971 | McMillen | 166/274 X |
| 4,856,589 | 8/1989 | Kuhlman et al. | 166/268 X |
| 5,267,615 | 12/1993 | Christiansen et al. | 166/268 X |

*Primary Examiner*—Ramon S. Britts
*Assistant Examiner*—Frank S. Tsang
*Attorney, Agent, or Firm*—Michael F. Martin

[57] ABSTRACT

Natural gas is reinjected into an earth formation for storage and/or stimulating the recovery of hydrocarbon liquids by mixing the gas with water at a pressure sufficient to maintain bubble flow of gas dispersed in a water flowstream in a range of volumetric gas fraction up to about twenty percent of total flow. A water and gas distribution system includes static flow mixers for maintaining uniform distribution of gas bubbles in the water flow stream through the distribution conduits. The mixers may comprise multi-stage bladed mixing elements of the same or opposite pitch and extending across the intersection of branch conduits with the main conduit of the distribution system. The water and gas may be mixed in an injection well having a tubing string extending within the well and having a distal end below the point of injection into an earth formation so that a uniform gas and water mixture enters the formation through the well perforations.

18 Claims, 2 Drawing Sheets

SIMULTANEOUS WATER AND GAS INJECTION INTO EARTH FORMATIONS

BACKGROUND OF THE INVENTION

1. Field of the Invention

The present invention pertains to a system and method for injecting a mixture of water and gas into a subterranean earth formation for storing the gas in the formation and for enhancing the recovery of hydrocarbon fluids from the formation.

2. Background

Reinjection of gases produced from subterranean earth formations has been carried out as a method of storing the gas for future production and for stimulating the production of hydrocarbon liquids such as crude oil. In certain earth formations the injection of gas alone will quickly result in migration of the gas towards oil production wells thereby disrupting the effective production of oil, particularly if the quantities of gas migrating are substantial, and resulting in unwanted production of the gas back to the surface.

In certain earth formations such as those found in the North Slope Oilfields of the State of Alaska mobility control over the flow of gas after reinjection into a formation has been provided by alternately injecting water and then gas into the formation. Reduced mobility without serious loss of use of the gas as a stimulant for the production of oil has been carried out with some effectiveness. However, the cost of providing separate water and gas injection piping networks leading to each injection well can become prohibitive and the alternate injection of slugs of water followed by slugs of gas, or vice versa, is not believed to be as effective in reducing the gas mobility within the formation as may be obtained if a mixture of water and gas is injected into the formation. Hence, simultaneous water and gas injection is believed to be desirable.

However, certain problems arise in providing for simultaneous water and gas injection into subterranean earth formations through injection wells. For example, uniform distribution of the gas and liquid mixture is difficult to obtain when the mixture must be transported long distances through piping networks and manifolds. Accordingly, the present invention is directed to a system which will provide effective injection of a uniform mixture of water and gas into selected injection wells to effectively control the mobility of the injected gas so that the earth formation serves as a gas storage reservoir while permitting at least some of the gas to migrate sufficiently through the reservoir to serve as a drive fluid to increase the yield of liquid hydrocarbons from the formation through production wells.

SUMMARY OF THE INVENTION

The present invention provides a system and method for simultaneously injecting a mixture of water and gas into a subterranean earth formation through one or more injection wells. In accordance with an important aspect of the present invention a simultaneous water and gas injection process is carried out through a system wherein gas may be injected into a conduit which is carrying water under moderately high pressure and wherein the ensuing mixture of water and gas is conducted to branch conduits leading to one or more injection wells. The conduit system includes mixing and flow splitting elements suitably disposed therein for maintaining a substantially uniform distribution of the gas-liquid mixture flowing through one or more branch conduits as well as the so called main conduit.

In accordance with another aspect of the present invention a simultaneous water and gas injection system for underground storage of gas is provided wherein a uniform gas-liquid mixture is distributed to each injection well through a single branch conduit by a uniquely arranged in-the-line blending or mixing device.

The present invention also contemplates an arrangement for injecting a water and gas mixture into an earth formation through an injection well wherein the water and gas are mixed within the well and distributed through well perforations opening into an earth formation in such a way that substantially uniform distribution of the water and gas mixture is obtained.

The present invention provides several advantages in handling produced gas from earth formations, or gas that is desired to be stored in earth formations regardless of its origin. The simultaneous injection of water and gas in a two phase mixture provides better mobility control of the gas than the alternating water and gas injection process wherein each phase is injected alone for a predetermined period of time. Simultaneous injection of water and gas is also believed to benefit the recovery of hydrocarbon liquids from earth formations in an improved manner by reducing the gas-to-oil ratio in oil production wells in earth formation zones wherein the simultaneous water and gas injection process has been conducted. As mentioned previously, the simultaneous injection of water and gas through multiple wells may be carried out in such a way that only one injection conduit may be required extending to each well, thereby reducing capital costs for this type of gas handling process. Simultaneous water and gas injection also increases the yield of hydrocarbon fluids from zones which are capable of producing such fluids.

Those skilled in the art will recognize the above mentioned features and advantages of the present invention together with other important aspects thereof upon reading the detailed description which follows in conjunction with the drawing.

DESCRIPTION OF PREFERRED EMBODIMENTS

Figure 1:
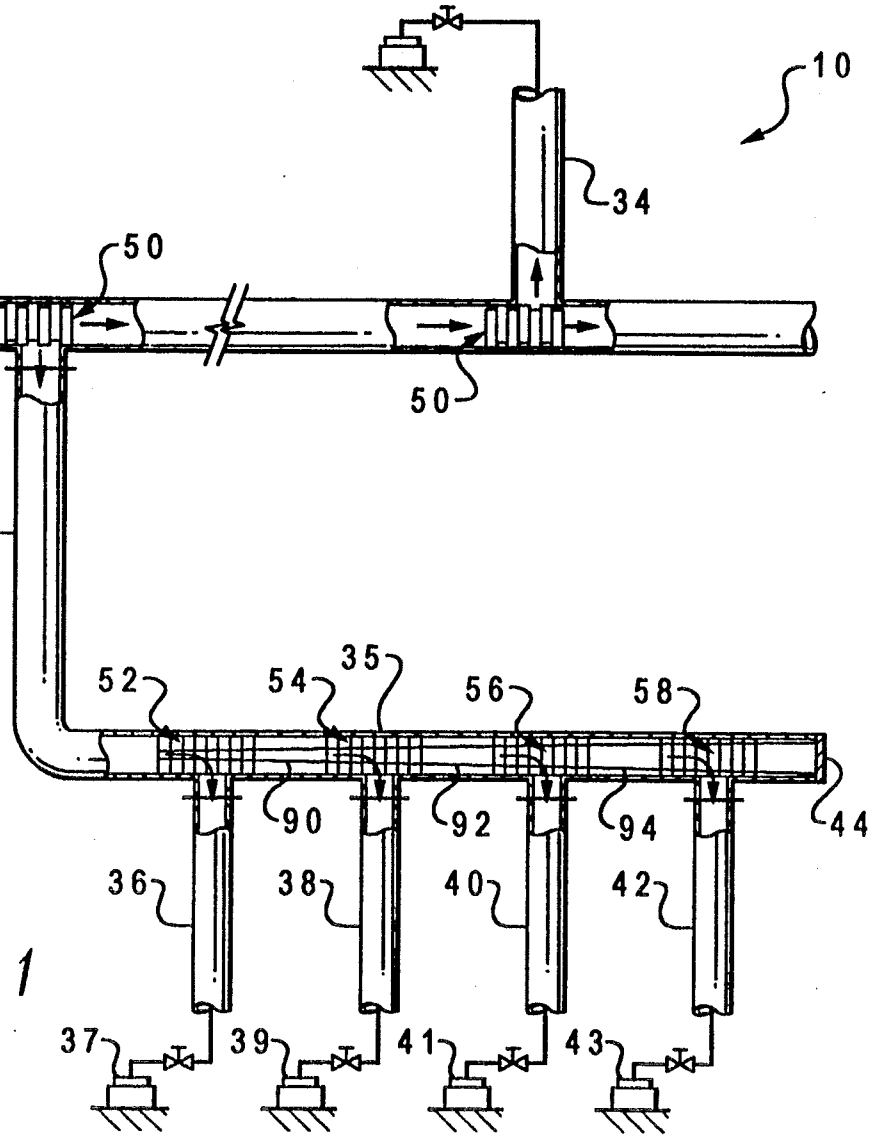
FIG. 1 is a schematic diagram of a system for simultaneously injecting a water and gas mixture into multiple wells in accordance with the invention.

In the description which follows like elements are marked throughout the specification and drawing with the same reference numerals, respectively. The drawing figures are not necessarily to scale and several features are shown in somewhat schematic form in the interest of clarity and conciseness.

Certain hydrocarbon production fields such as the North Slope Oilfields of Alaska have been and continue to be capable of producing significant amounts of natural gas in addition to crude oil. Storage of most of this gas is obtained by reinjecting the gas into certain zones in the earth formations of the oil field or in the vicinity of the oil field. If these zones do not have a natural "gas cap" or "dome" as a containment area then migration of the gas through the earth formation is controlled by injecting water into the formation. Conventional practice is to inject water for a period of time through an injection well and then inject gas for a second period of time through the same well. This process is alternated substantially continuously or until the quantity of gas produced and designated for storage has been injected back into the formation. Injection of water and gas is also somewhat useful in stimulating oil production. However, it is desirable to slow or retard the migration of the gas towards oil production wells in order to hold the so called gas-to-oil ratio of the produced fluid at a minimum and also minimize the need to reinject gas which has been previously injected and used as a drive fluid. Test operations have indicated that the injection of a mixture of water and gas, referred to as simultaneous water and gas injection, has certain benefits in controlling the mobility of the gas within the earth formation into which it is injected and the gas and water mixture also is somewhat more productive as a stimulant or drive fluid for driving hydrocarbon liquids such as crude oil toward production wells.

FIG. 1 illustrates part of an exemplary system in accordance with the present invention for conducting a uniform mixture of water and gas to plural injection wells. The system illustrated in FIG. 1 is generally designated by the numeral 10 and includes a gas supply conduit 12 having a conventional throttling valve 14 and a flowmeter 16 interposed therein. The system 10 also includes a water supply conduit 18 having a conventional throttling valve 20 and flowmeter 22 interposed therein. The source of water for the conduit 18 may be that produced from an oilfield or comprise treated sea water, for example. Other sources of water, may, of course, be utilized. The gas conduit 12 is typically connected to a gas processing and handling facility, not shown, wherein produced gas from an oil field is separated from the oil and possibly subjected to treatment to remove certain hazardous fractions, such as hydrogen sulfide, therefrom before being conducted to the system 10. As shown in FIG. 1 gas is injected into the conduit 18 through a suitable nozzle 28 so that a mixture of gas and water proceeds through a main conduit section 30 to one or more branch conduits 32 and 34 illustrated. Each of the branch conduits 32 and 34 may lead to one or more injection wells. By way of example the conduit 32 is illustrated as terminating in a manifold 35 having plural branch conduits 36, 38, 40 and 42 extending therefrom and leading to respective injection wells 37, 39, 41 and 43. The branch conduits 36, 38, 40 and 42 are shown extending from the manifold 35 at right angles although other angles are acceptable. The conduit portion or manifold 35 terminates in a flange 44 which is adapted to support a plurality of fluid mixing devices which will be described in further detail herein.

Figure 3:
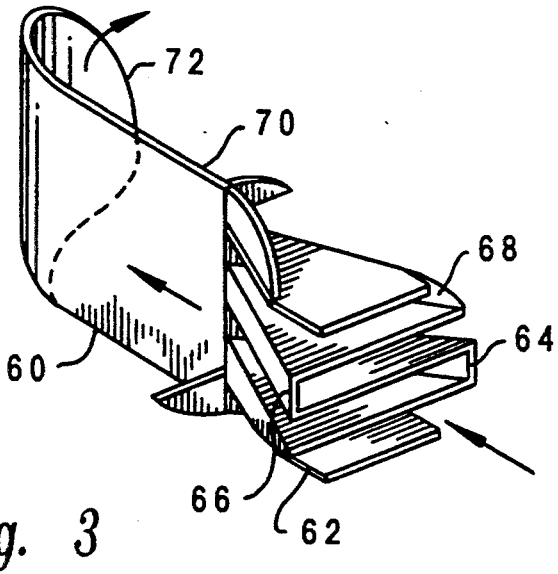
FIG. 3 is a detail perspective view of a flow stratifying and splitting device useful in the system of the present invention.

Referring further to FIG. 1 the present invention contemplates that a water and gas mixture may be provided for flow through the conduit 30 over an extended distance wherein the volumetric fraction of gas in the total flow may be up to about 20%. By way of example, the ratio of gas to liquid in terms of standard cubic feet of gas per stock tank barrel of water (42 U.S. gallons per barrel) may be in the range of 50 to 250. In this range of gas to liquid ratio it is contemplated that the gas will exist as bubbles dispersed in a liquid flow stream if the pressure is maintained at approximately 2500 psig or greater. In order to obtain uniform phase distribution of the fluid flowing through the conduit 30 as well as the branch conduits 32 and 34 and the branch conduits 36, 38, 40 and 42 extending from the manifold 35, mixing and flow splitting of the two phase fluid flow stream is required. FIG. 1 illustrates a mixing device 50 interposed in the conduit 30 between the branch conduit 32 and the injection nozzle 28. Second and third mixing devices 50 are interposed in the conduit 30 at the branch conduits 32 and 34. Still further, the system 10 includes mixing devices 52, 54, 56 and 58 interposed in the manifold 35 adjacent to and extending over ports formed by the intersections of the branch conduits 36, 38, 40 and 42, respectively, with the manifold 35. FIG. 3 illustrates a flow stratifier and splitter element designated by the numeral 60 which may be interposed at the intersections of the branch conduits 32 and 34 with the conduit 30 in place of the mixing devices 50. The elements 60 will be explained in further detail herein.

The mixing devices 50, 52, 54, 56 and 58 may be of a type similar to that described in U.S. Pat. No. 4,123,178 to R. N. Salzman et al, issued Oct. 31, 1978. The mixing devices 50, 52, 54, 56 and 58 may also be of a type commercially available from Komax Systems, Inc., Wilmington, California. The mixing devices 52, 54, 56 and 58 may also be modified in accordance with the example illustrated in FIG. 2. The exemplary mixing devices 50 comprise a plurality of axially spaced mixing segments which are each characterized by plural, three preferably, radially projecting, circumferancially spaced, pitched blades. These segments are stationary in the conduit 30 and serve to impart a spiral direction of flow of fluid passing through the mixing device. The segments may be rotatably indexed relative to each other to modify the degree of turbulent mixing that occurs and selected ones of the segments or mixing stages may have their blades configured of opposite pitch to increase the turbulence and mixing of the fluid flowing through the mixing device.

In order to provide uniform gas-to-liquid ratio of the fluid flowing through the conduits 32 and 34, the mixing devices 50 are interposed in conduit 30 across the ports forming the intersections of the branch conduits 32 and 34 with conduit 30. Alternatively, the stratifier and flow splitting devices 60 may be interposed at the junctions of the conduits 32 and 34 with the conduit 30. FIG. 3 illustrates one embodiment of a stratifier and flow splitter 60 for interpositioning in the cylindrical conduit 30. The flow splitter 60 includes a stratifier section made up of plural transversely stacked duct portions 62, 64, 66 and 68 alternate ones of which direct flow entering the duct portions to opposite sides of a flow splitting plate 70 which has a curved distal end 72 for directing flow into the branch conduits 32 or 34. The flow stratifying and splitting device 60 may be of the type described in U.S. Pat. No. 4,824,614 issued Apr. 25, 1989 to J. A. Jones.

Figure 2:
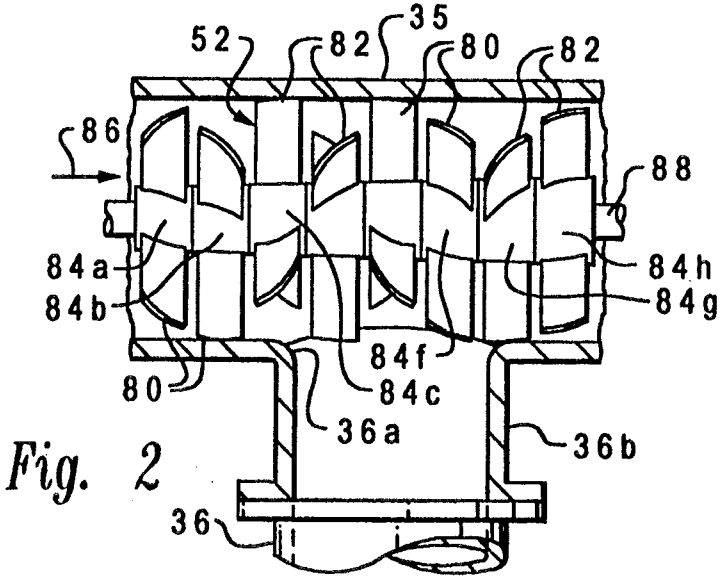
FIG. 2 is a detail view illustrating a unique arrangement of one type of mixing or blending device advantageously used in the system of the present invention.

Referring to FIG. 2 the mixing device 52 is illustrated by way of example as comprising multiple axially spaced mixing segments or stages 80, and 82, each of which are multi-bladed elements of opposite pitch, respectively. The mixing segments 80 and 82 are similar except that each successive serially spaced segment 80 and 82 has a hub portion 84*a*, 84*b*, 84*c* and so on which is of increasing diameter with respect to the direction of fluid flow through the manifold 35, as indicated by the arrow 86. In other words the hub portion 84*a* is of the Smallest diameter and the hub portion 84*h* is of the largest diameter so that a decreasing cross sectional flow area is experienced by fluid flowing through the manifold 35 in the direction of the arrow 86. The hub portions of each of the mixing stages 80 and 82 are supported on a suitable axially extending rod or shaft 88 in a manner similar to that described in U.S. Pat. No. 4,123,178. The mixing devices 50 may be similar to the device 52.

Moreover, tapered coaxial hub portions 90, 92 and 94 extend between each of the mixing devices 52, 54 and 56 so that a continuously decreasing cross sectional flow area exists in manifold 35 for fluid flowing through the manifold toward the flange 44. In this way fluid flowing into the branch conduits 36, 38, 40 and 42 will be maintained at substantially constant velocity to assist in mixing the water and gas and to aid in maintaining even distribution of the water and gas mixture flowing to each of the injection wells 37, 39, 41 and 43. Suitable throttling valves may be interposed in each of the conduits 36, 38, 40 and 42 as shown to adjust the flow rate of fluid into each of the above referenced injection wells. It is indicated that by placing the mixing devices 52, 54, 56 and 58 across the ports forming the intersections of the respective conduits 36, 38, 40 and 42 with the manifold portion 35 that a thorough and uniform mixture of water and gas is diverted into each of the branch conduits from the manifold portion. In FIG. 2, for example, a port 36*a* is formed by the intersection of a short integral part 36*b* of the branch conduit 36 with the manifold 35. The mixing devices 52, 54, 56 and 58 are each supported on the center rod 88 which is suitably attached to the flange 44 whereby removal of the flange 44 from the manifold 35 will enable removal of the assembly of the mixing devices 52, 54, 56 and 58 from the manifold for repair or adjustment of the position of the mixing segments or stages.

Accordingly, gas reinjection into a subterranean earth formation for storage and or for enhanced recovery of oil in place in the earth formation may be effectively carried out with a system such as illustrated in FIG. 1. By providing a conduit network for conducting a mixture of water and gas having the flow treatment devices illustrated and described a substantially uniform fluid mixture may be conducted to plural injection wells. In this way gas injection may be commenced through a system of injection wells having an existing water or gas injection conduit network without the requirement for constructing separate water and gas conduits to each injection well. With the flow mixing devices interposed in a conduit network of the type described, simultaneous water and gas injection may be effectively implemented in new or existing injection zones.

Figure 4:
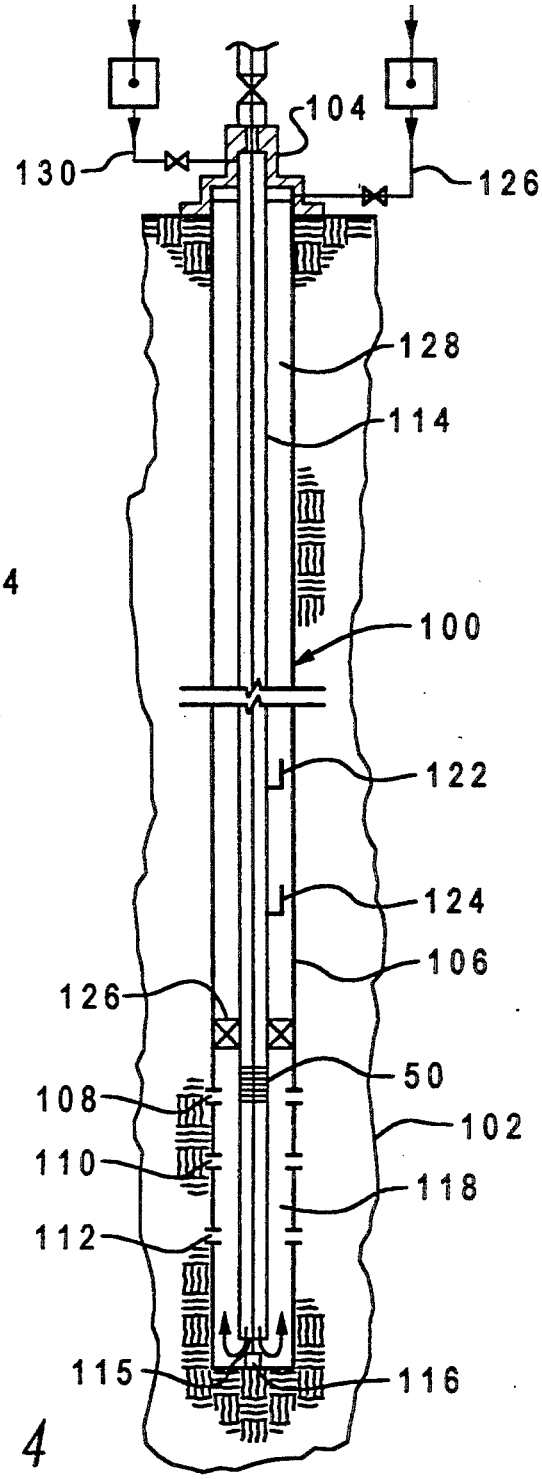
FIG. 4 is a schematic diagram of an injection well for simultaneously injecting a mixture of water and gas into an earth formation in accordance with the present invention.

In certain situations where conduit networks already exist for conducting both water and gas to an injection well or where it is advantageous to provide separate water and gas conduits to an injection well the gas may be mixed with injection water in the well itself. Referring to FIG. 4 there is illustrated a water and gas injection well 100 extending into an earth formation 102 from a conventional wellhead 104. The well 100 includes a conventional casing 106 perforated at 108, 110 and 112 in a conventional manner whereby injection fluids may be forced into the formation 102. A conventional tubing string 114 extends within the well 100 from the wellhead 104 and terminates at a distal end 115 which, preferably, may be below the perforations 108, 110 and 112 to minimize separation of gas and liquid before entering the formation 102. A fluid pressure sensor 116 is preferably disposed in wellbore space 118 below the tubing string 114 for making measurements of the fluid pressure in the wellbore space if and when needed. The tubing string 114 may be fitted with one or more conventional gas lift mandrels 122 and 124 interposed in the tubing string above a packer 126. One or the other of the mandrels 122 and 124 may be fitted with a dummy valve and a conventional, so-called gas lift valve, respectively, whereby injection gas may be conducted by way of a conduit 126 into the annulus space 128 to flow into the tubing string 114 through one or the other of the mandrels 122 and 124. The mandrels 122 and 124 and associated valves, not shown, may be of a type commercially available from Halliburton Energy Services, Dallas, Tx. Injection water is conducted by way of conduit 130 to flow downward into the wellbore 118 through the tubing string 114. One of the mixing devices 50 may be interposed in the tubing string between the point of gas injection and the distal end 115. Alternatively, gas may be injected down through the tubing 114 and water through the annulus space 128.

As shown in FIG. 4 the tubing string 114 extends below the perforations 108, 110 and 112 whereby a water and gas mixture discharged from the tubing string is required to flow upward in the wellbore space 118 before entering the perforations. With the arrangement shown minimal separation of water and gas is expected to occur before the mixture enters the earth formation 102 as compared with water and gas separation which is likely to occur if the distal end of the tubing string was disposed above one or all of the sets of perforations. Moreover, the pressure gauge 116 may be used to monitor wellbore pressure to verify that the mixture of water and gas entering the wellbore space 118 is consistent and uniform for each well, that is the gas to liquid ratio is essentially the same for all wells. For example, natural gas dispersed in water in bubble flow in the range of gas to liquid ratios mentioned above may result in up to twenty percent gas volume in the wellbore which would effectively lower the wellbore hydrostatic pressure including the so called bottom hole pressure. For example, about a 200 psig pressure reduction in the static bottom hole pressure may be expected, depending on well depth and injection pressure. Accordingly, if such a pressure reduction would result in the pressure at the perforations dropping below the pressure required to open fractures in the formation 102, reduced injectivity would be expected.

The operation of the system 10 illustrated in FIGS. 1–3 and the operation of injecting a water and gas mixture by mixing the gas with the water in a well tubing in a configuration such as illustrated in FIG. 4 is believed to be readily understandable to those skilled in the art from the foregoing description. With regard to the system 10 a surfactant such as ethoxylated alcohol or certain corrosion inhibitors may also be injected into the water supply conduit 18 at an injection nozzle 19 illustrated in FIG. 1. The presence of a surfactant such as the aforementioned ethoxylated alcohol is indicated to be beneficial in the formation and dispersement of gas bubbles in a water flowstream. Moreover, it may be required to inject certain corrosion inhibitors into the water flow stream if the gas injected would be indicated to tend to form certain acids which might be harmful to the system components and/or the formation into which the water and gas mixture is being injected.

Although preferred embodiments of systems and methods for injecting water and gas into earth formations have been described hereinabove those skilled in the art will recognize that various substitutions and modifications may be made to the invention without departing from the scope and spirit of the appended claims.

What is claimed is:

1. A system for simultaneous injection of water and gas into a subterranean earth formation through a plurality of injection wells, comprising:

a water and gas mixture supply conduit including a manifold portion;

means for introducing a mixture of water and gas into said mixture supply conduit;

a plurality of injection well conduits connected to said manifold portion at spaced apart points on said manifold portion; and mixing means interposed in said manifold portion to provide uniform mixing of water and gas flowing through said manifold portion and into each of said injection well conduits.

2. The system set forth in claim 1 wherein:

said mixing means comprises a plurality of mixing devices extending across the intersections of said injection well conduits with said manifold portion, respectively.

3. The system set forth in claim 2 wherein:

said mixing devices comprise segments having plural radially extending blades for diverting the flow of a water and gas mixture flowing through said manifold portion.

4. The system set forth in claim 3 wherein:

at least one of said segments has blades which are of a pitch opposite to that of the blades of another of said segments of said mixing device.

5. The system set forth in claim 4 wherein:

each of said segments has a hub portion of progressively greater diameter than the hub portion of a segment which is disposed upstream with respect to the direction of flow of said water and gas mixture through said manifold portion so that the velocity of said water and gas mixture is maintained substantially constant through said manifold portion and into each of said conduits leading to said injection wells.

6. The system set forth in claim 1 wherein:

the volumetric gas fraction in said water and gas mixture is in the range of up to about twenty percent.

7. A system for reinjecting produced natural gas into an earth formation for containment of said gas in said formation and for enhanced recovery of crude oil from said formation through a production well, said system comprising:

a plurality of injection wells each having a conduit leading thereto for transporting a mixture of gas and water for injection of said mixture into said earth formation;

a main mixture supply conduit for transporting said mixture to said conduits leading to said injection wells; and at least one mixing means interposed in said supply conduit for mixing said water and gas mixture to provide a uniform distribution of gas bubbles in a water flow stream for injection into said wells, respectively.

8. The system set forth in claim 7 wherein:

the volumetric gas fraction in said mixture is in a range of up to about twenty percent.

9. The system set forth in claim 7 wherein:

said mixture is in the range of 50 standard cubic feet of gas per stock tank barrel of water to 250 standard cubic feet of gas per stock tank barrel of water.

10. The system set forth in claim 9 wherein:

said mixture is maintained as gas bubbles dispersed in a water flow stream through said supply conduit at a pressure of not less than 2500 psig.

11. The system set forth in claim 8 wherein:

said injection wells include pressure sensors disposed therein for sensing the hydrostatic pressure of said mixture in said wells.

12. An injection well for simultaneous injection of a mixture of water and gas into a subterranean earth formation penetrated by said well, said well comprising:

a casing portion extending into said formation and a plurality of substantially vertically spaced perforations in said casing portion for communicating a water and gas mixture between said well and said earth formations;

a tubing string extending within said well having a distal end for discharging a water and gas mixture into said well; and said tubing string and said casing form an annular space in said well in communication with a source of one of water and pressure gas and said tubing string is in communication with a wellhead connected to a source of the other of water and pressure gas and said tubing string includes means for introducing said one of water and pressure gas from said annular space into said tubing string to mix with the other of said pressure gas and water in said tubing string between said wellhead and said distal end of said tubing string.

13. The well set forth in claim 12 wherein:

the distal end of said tubing string is disposed at a point below the lowest perforation to minimize stratification and separation of gas from water in said mixture flowing into said earth formation through said perforations, respectively.

14. The well set forth in claim 12 including:

mixing means interposed in said tubing string between said means for introducing said one of water and pressure gas and said distal end of said tubing string.

15. The well set forth in claim 12 including:

a pressure sensor disposed in said well for measuring the hydrostatic pressure of said mixture of water and gas flowing into said perforations.

16. In a system for injecting a mixture of water and gas into a subterranean earth formation through at least one injection well, a water supply conduit, a gas supply conduit, and a main mixture supply conduit for conducting a mixture of water and gas to said injection well, means for injecting gas into said water for flow through said mixture supply conduit, mixing means for distributing water and gas in said mixture substantially uniformly in said mixture supply conduit, a branch conduit intersecting said mixture supply conduit and a flow splitter interposed in said mixture supply conduit for diverting a uniform portion of said mixture into said branch conduit.

17. A method for reinjecting produced natural gas into an earth formation for containment of said gas in said formation comprising the steps of:

providing at least one injection well having a conduit leading thereto for transporting a mixture of gas and water for injection of said mixture into said earth formation;

providing a supply conduit for transporting a mixture of water and gas wherein the volumetric fraction of gas in the total flow is up to about twenty percent, said supply conduit being in communication with said conduit leading to said one injection well;

providing mixing means interposed in one of said conduits for mixing said water and gas to provide a uniform distribution of gas bubbles in a water flowstream;

injecting gas and water into said supply conduit for flow through said mixing means to uniformly distribute gas bubbles in said water; and injecting said mixture of water and gas into said earth formation through said injection well for containment of said gas in said earth formation.

18. A method for injecting produced natural gas into an earth formation for containment of said gas in said formation, comprising the steps of:

providing an injection well extending into said formation and including a tubing string extending within said well having a distal end for discharging a mixture of water and gas into a wellbore for flow into said formation;

conducting one of said water and gas into said tubing string through a wellhead of said injection well;

injecting the other of water and gas into an annular space between said tubing string and a wall of said well; and mixing said water and gas in said tubing string before ejection of said water and gas into said wellbore at the distal end of said tubing string so as to provide a mixture of water and gas for injection into said formation through said injection well.

* * * * *